US005462473A

United States Patent [19]

Sheller

[11] Patent Number: 5,462,473

[45] Date of Patent: Oct. 31, 1995

[54] TOY WITH SLOW MOVEMENT RECOVERY

[76] Inventor: Ken Sheller, 30 W. 15 St., New York, N.Y. 10011

[21] Appl. No.: 269,570

[22] Filed: Jul. 1, 1994

[51] Int. Cl.[6] ..... A63H 3/06

[52] U.S. Cl. ..... 446/183; 446/486

[58] Field of Search ..... 446/199, 188, 446/183, 184, 190, 197, 198, 368, 180, 213, 176, 390, 226, 486

[56] References Cited

U.S. PATENT DOCUMENTS

| | | | |
|---|---|---|---|
| 494,410 | 1/1893 | Carpenter | 446/183 |
| 754,148 | 3/1904 | Kuhleman | 446/184 |
| 2,817,187 | 12/1957 | Auzin | 446/184 |
| 2,830,402 | 4/1958 | Schleich | 446/385 |
| 3,238,599 | 3/1966 | Bauman | 446/199 X |
| 3,601,923 | 8/1971 | Rosenberg | 446/320 X |
| 3,977,292 | 8/1976 | Favilli et al. | 446/184 X |
| 4,169,336 | 10/1979 | Kuhn | 446/320 X |
| 4,179,842 | 12/1979 | Fauls | 446/197 X |
| 4,188,746 | 2/1980 | Wolf | 446/198 |
| 4,380,134 | 4/1983 | Taluba et al. | 446/188 |
| 4,759,737 | 7/1988 | Ferenczi | 446/183 |
| 5,162,013 | 11/1992 | von Mohr | 446/183 X |

FOREIGN PATENT DOCUMENTS

| | | | |
|---|---|---|---|
| 771006 | 3/1957 | United Kingdom | 446/184 |

OTHER PUBLICATIONS

Copy of Packaging for Krusher (™) Toy manufactured by Mattel, Calif. in 1979.

Copy of Packaging for Dino–Roarr (™) Toy Brontosaurus Sold By Fisher–Price 1992.

*Primary Examiner*—Mickey Yu

*Attorney, Agent, or Firm*—Robert W. J. Usher

[57] ABSTRACT

Various toys simulating animal characters have appendages with inserts therein which produce slow return motion of the appendages from positions to which they have been deformed to simulate a natural movement or gesture. The inserts each includes an elongate, tubular, resiliently compressible air bags with an impermeable (air tight), skin of plastic or rubber, penetrated by a slow leak valve formed as a small hole and stuffed with resiliently compressible synthetic fiber or foam. In one example the air bag is located in the body of a doll to extend across the chest and along respective arms, whereby a child can deform the arms between open and closed positions, compressing the air bag so that the resiliency returns the arms slowly to an undeformed position while producing a simulated natural gesture of affection such as giving or requesting a hug.

14 Claims, 6 Drawing Sheets

FIG. 3
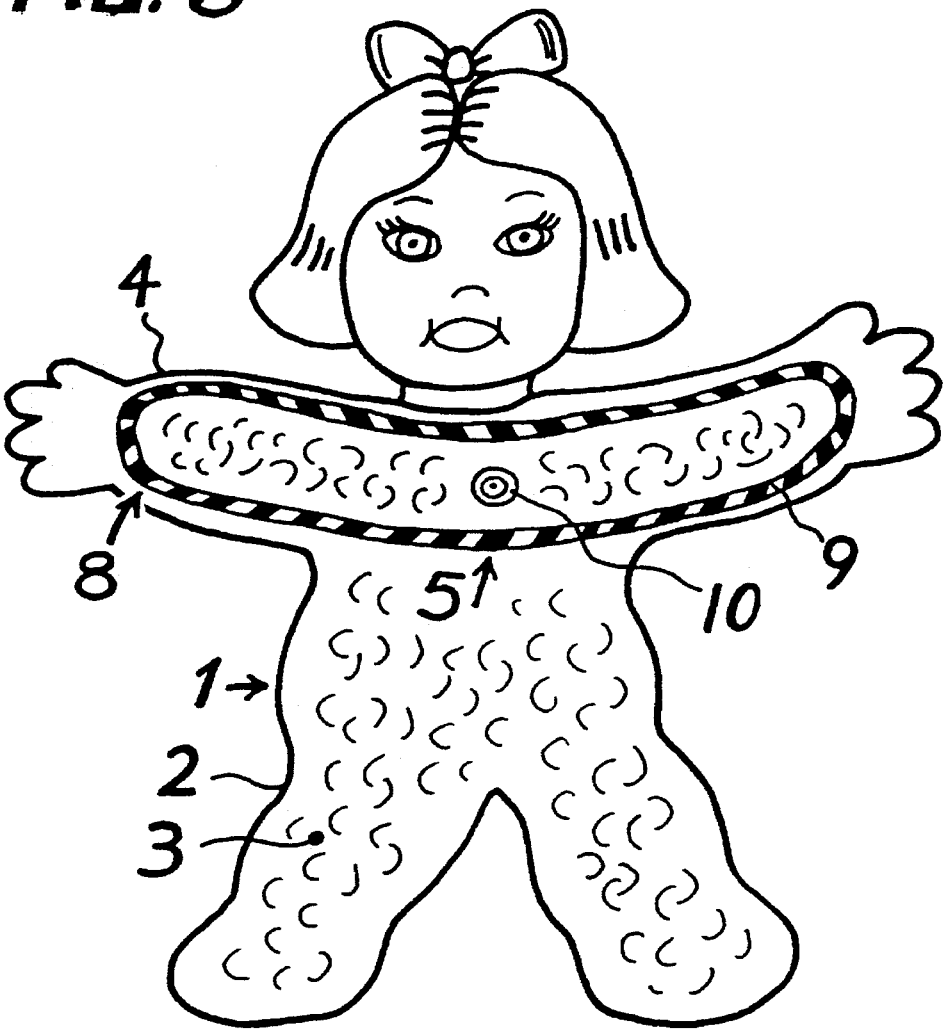
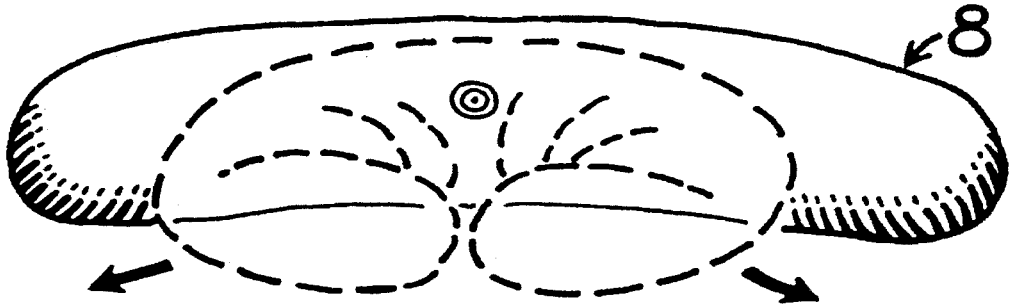
FIG. 5

TOY WITH SLOW MOVEMENT RECOVERY

FIELD OF THE INVENTION

The invention relates to toy characters or dolls which can simulate a natural gesture of affection by slow movement recovery, particularly an arm movement, offering or requesting a hug which is emotionally satisfying to a young child.

BACKGROUND OF THE INVENTION

It has long been desired to provide toy characters producing life-like movements or gestures. U.S. Pat. No. 2,830,402 issued Apr. 15, 1958 to Schleich and U.S. Pat. No. 4,169,336 issued Oct. 2, 1979 to Kuhn disclose two prior attempts utilizing slow movement recovery.

The former teaches that the entire toy should be manufactured of solid material having retarded resiliency, while the latter reference teaches filling an elastic skin with a highly viscous liquid such as corn syrup.

However, both prior approaches result in dense structures so that a life-size or huggable size doll is not sufficiently light to be carried easily, if at all, by a small child. In addition, as a result of their skin texture and firmness, such dolls do not have huggable, soft or cuddly qualities necessary to provide comfort to a small child.

Another approach, a toy known as KRUSHAR (Trademark), shown in FIG. 1, and manufactured by Mattel, California in 1979, comprises an animal monster character or figure having a resilient air tight skin of vinyl and stuffed completely with resiliently compressible, open cell foam. A valve mechanism is mounted in the back of the figure and adjustable between a rapid leak condition in which the toy is intended to be crushed by a child, to a slow leak condition, in which the figure restores itself slowly as a whole to an erect position, in an attempt to provide a degree of animation.

Although the resulting figure is much less dense and can therefore be made in larger sizes, it is still undesirably heavy and, as the entire body must be impervious, cannot be made of a porous, cloth like fabric which is soft to the touch so as to comfort and please a young child. Furthermore, individual limb movement cannot be controlled to provide the slow recovery necessary to produce life-like gestures, only restorative movement of the entire figure is practicable. In addition, it is relatively difficult for a child to completely crush the figure to maximize the restorative movement as the figure must be pushed against the ground or table top requiring an extreme effort by the child.

A known sounding toy DINO-ROARRRRR (Trademark), shown in FIG. 2, manufactured and sold by Fisher Price 1992, has the form of a dinosaur and includes an air bag 6 filled with resilient plastic foam concealed within the body region and which incorporates a slow leak valve directing air across a sounding reed 7 associated with a resonating tube to produce a long period of sound during restoration after squeezing. Although the toy is designed solely for producing a sound by gently squeezing, the air bag extends between the torso and the root of the tail so that a relatively large force applied in the precise direction shown by the arrow deforming the toy to the position shown by broken lines to crush the torso against the tail, will also result in a recovery which, although initially fast, may be relatively slow only in latter stages, when the toy has almost restored to the fully erect position. However, such crushing is not the normal use of the toy and, particularly as the air bag is relatively fat and is deeply inserted into the body completely surrounded by stuffing and isolated from the appendages, it would be physically difficult to fold, (again requiring forcing against the ground or a table top), so that any significant effect could not be achieved on a reliable basis by young children. Furthermore, the action would be unnaturally destructive, even repugnant, for a young child with an affectionate response in mind as perceived as hurting the toy and would be destroying the make-believe.

SUMMARY OF THE INVENTION

It is an object of the invention to provide a toy character capable of slow movement recovery so that it can simulate a natural gesture of affection, particularly requesting or giving a hug, by return movement of a body part flexed by a young child, thereby satisfying a young child's gentler emotional needs.

According to the invention, a life-size huggable doll has a body comprising a porous, soft, cloth like fabric covering a soft stuffing, the body including a flexible pair of arms extending from a chest portion in one of open and closed positions, a slow return motion producing insert comprising an elongate, tubular, resiliently compressible air bag with a slow leak means and mounted in the body to extend across the chest and along respective arms, whereby a child can deform the arms from one of the positions to another, compressing the air bag, the resiling action of which returns said arms slowly to an undeformed position while producing a simulated natural gesture of affection.

More particularly, the air bag comprises an impermeable skin stuffed with resiliently compressible foam. The air bag may be of U-shape in undeformed condition, locating the arms extending together forward from the chest so that the arms can be deformed by a child to an open position extending outwardly away from each other from opposite sides of the chest and will return relatively slowly producing a simulated hugging gesture.

Alternatively, the air bag may be straight in undeformed condition, locating the arms extending outwardly, away from each other from opposite sides of the chest so that the arms can be deformed forwards by a child to a position extending together in front of the chest and will return relatively slowly, moving apart simulating a gentle request for a hug and showing the child how much the doll loves the child.

It will be appreciated that a doll incorporating the insert is sufficiently light to be made in life-like sizes and still be handled by a young child while the slow return motion producing insert is of very simple, highly reliable construction, virtually undetectable when installed, and inexpensive to manufacture.

The force required to deform the doll is relatively gentle, requiring only movement apart of the arms or folding across the chest with some compression thereof, possibly achieved by a hugging action. In addition to hugging, the non-aggressive limb manipulation and squeezing is often natural to a young child.

According to another aspect of the invention, a toy character comprises an appendage which is flexible for movement by a child between open and closed positions, a slow return motion producing insert consisting essentially of an elongate, narrow, tubular, resiliently compressible air bag with slow leak means, positioned inside the appendage, whereby movement of said flexible body part from one of the positions to another, compresses the air bag so that the resiling action of the air bag will cause said body part to return to an undeformed position while producing a simulated natural gesture.

According to a further aspect, the invention comprises the insert per se. The air bag may have a length which is at least triple the minimum thickness.

BRIEF DESCRIPTION OF THE DRAWINGS

Specific embodiments of the invention will now be described by way of example only and with reference to the accompanying drawings in which:

FIG. 3 is a diagrammatic elevational view, partly in cross-sectional of a first embodiment of the invention;

FIG. 5 is a diagrammatic perspective view of the slow motion producing insert of FIG. 4, indicating the deformation thereof;

DESCRIPTION OF PARTICULAR EMBODIMENTS

Figure 1:
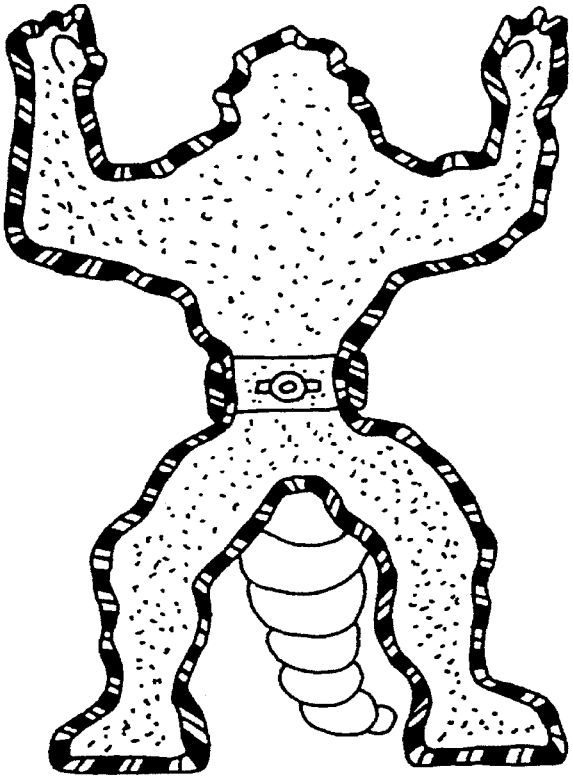
FIG. 1 PRIOR ART
FIG. 1 is a diagrammatic elevational view, partly in cross-section, of a toy character according to the prior art.
Figure 2:
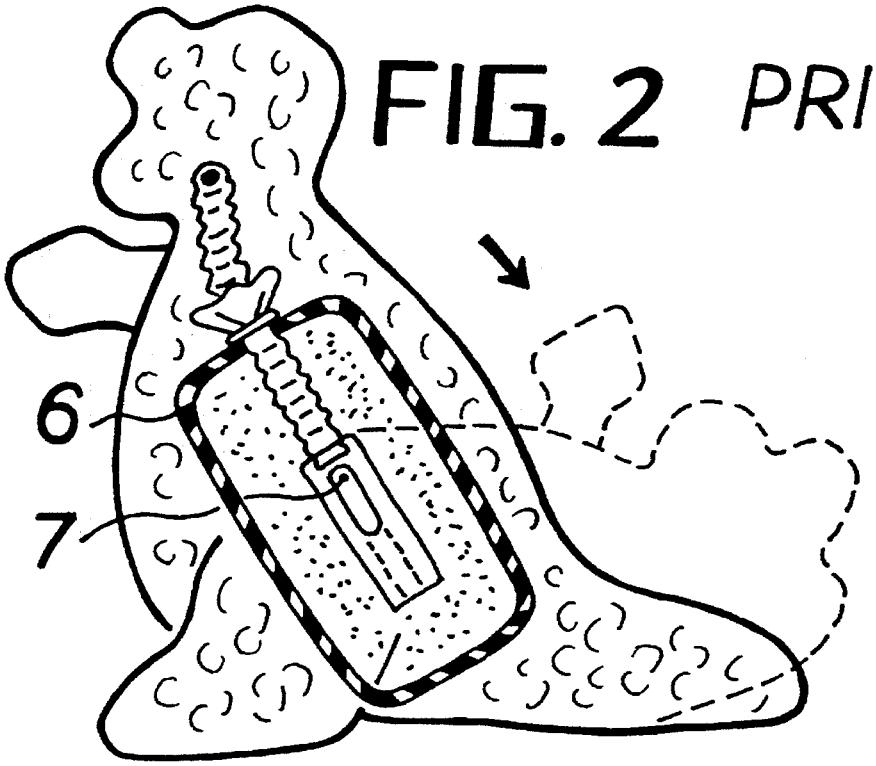
FIG. 2 PRIOR ART
FIG. 2 is a diagrammatic elevational view, partly in cross-section, of another toy character according to the prior art.
Figure 4:
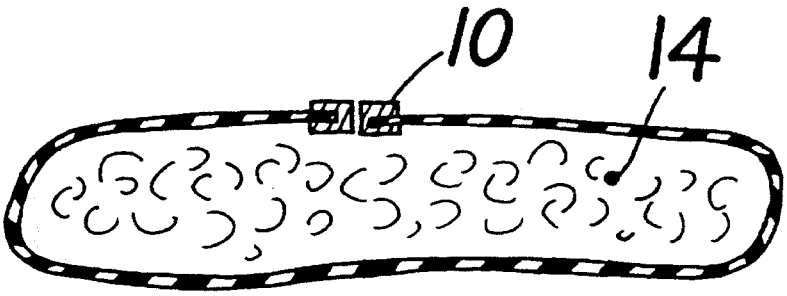
FIG. 4 is a diagrammatic cross-sectional view of the slow return motion producing insert shown in FIG. 3.

As shown in FIG. 3, a life-size huggable doll has a body 1 comprising a porous, soft, cloth-like fabric 2 covering a soft stuffing 3. The body 1 includes a pair of arms 4 extending from a chest portion 5 and flexible between a stable open position extending straight outwardly in opposite directions from respective opposite sides of the chest portion and a closed together position, folded across the chest as shown in FIG. 5 in broken lines. A slow return motion producing insert 8, shown also in FIG. 4 and 5, and comprising an elongate, tubular, resiliently compressible air bag 9 with a slow leak means 10 is mounted in the body to extend across the chest portion 5 and along respective arms 4. The air bag 9 comprises an impermeable (air tight), skin 13 of suitable plastic or rubber, penetrated by a slow leak valve 10 formed as a small hole in a valve body, and is stuffed with resiliently compressible synthetic fiber 14 or foam 16. Alternatively, the valve may simply be formed by one or more small holes in the skin. The air bag is generally straight in undeformed condition, locating the arms extending outwardly, away from each other, as shown. The arms can be readily deformed by a young child to a position extending across the front of the chest with slight compression thereof, compressing the air bag, the resiling action of which returns said arms slowly so that they move apart, simulating a gentle request for a hug.

Figure 6:
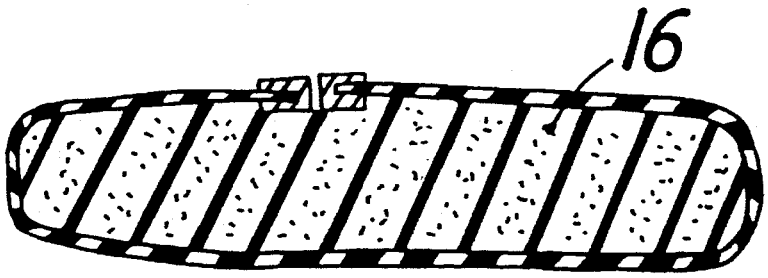
FIG. 6 is a diagrammatic cross-sectional view of an alternative slow return motion producing insert.

In an alternative embodiment of insert 8', shown in FIG. 6, the stuffing is sponge rubber.

Figure 7:
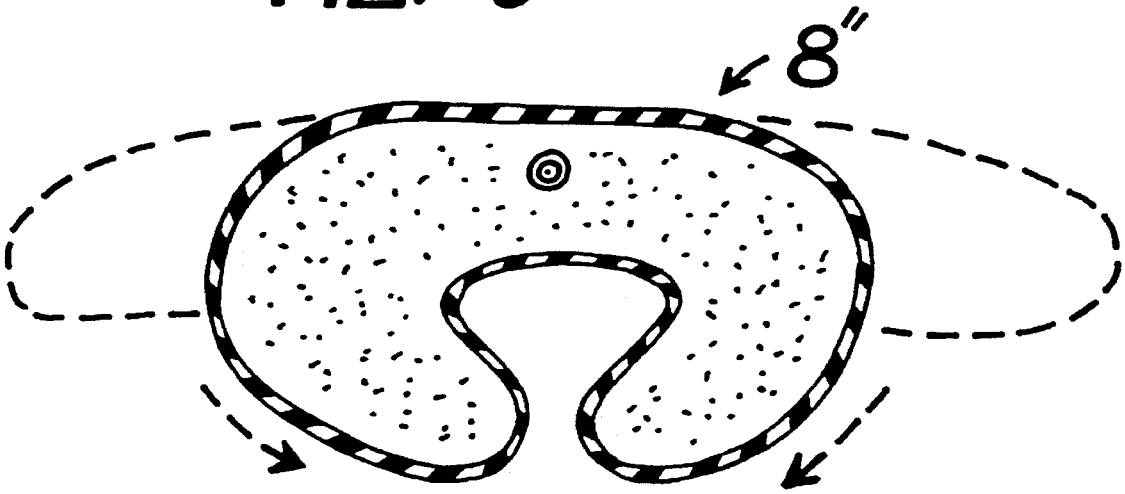
FIG. 7 is a diagrammatic cross-sectional view of another alternative slow motion producing insert, indicating the deformation thereof.

In another alternative insert 8" shown in FIG. 7, the air bag is U-shape in undeformed condition, so as to locate the arms extending forward from the chest in stable condition. The arms can then be deformed by a child to an open position extending away from each other on opposite sides of the chest, similar to the position shown in FIG. 3, and will return relatively slowly producing a simulated hugging gesture.

As the approximate height of this embodiment the doll is 18 inches while the weight is only approximately one pound, it will be appreciated that although in life like size the doll is still sufficiently light to be carried by a young child. The slow return motion producing insert is of very simple construction, virtually undetectable when installed, highly reliable and inexpensive to manufacture.

The force required to deform the doll is relatively gentle requiring only movement apart of the arms or folding across the chest with some compression thereof, possibly achieved by a hugging action. In addition to hugging, the non-aggressive limb manipulation and squeezing is often natural to a young child.

Figure 8A:
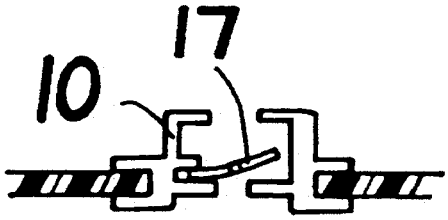
FIGS. 8A and 8B are diagrammatic cross-sectional views of alternative slow leak valves of inserts.
Figure 8B:
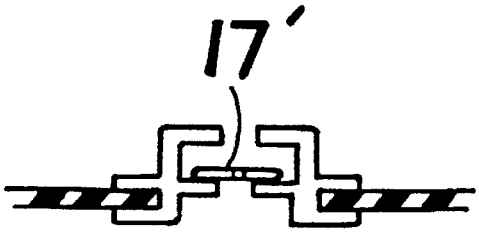

Alternative dual speed valve constructions are shown in FIGS. 8A and 8B, respectively, in which valves 10' and 10", comprise small holes in a flapper member 17 trapped at one edge over a larger valve orifice in a valve body and, a loose piece member 17' captured for limited float over a larger valve orifice. The positive air pressure produced during compression of the air bag will in each embodiment force the valve members away from the larger valve orifice to permit easy and rapid compression while the negative pressure of the resiling action will draw the valve members over the larger valve orifice to permit only slow return.

Figure 9:
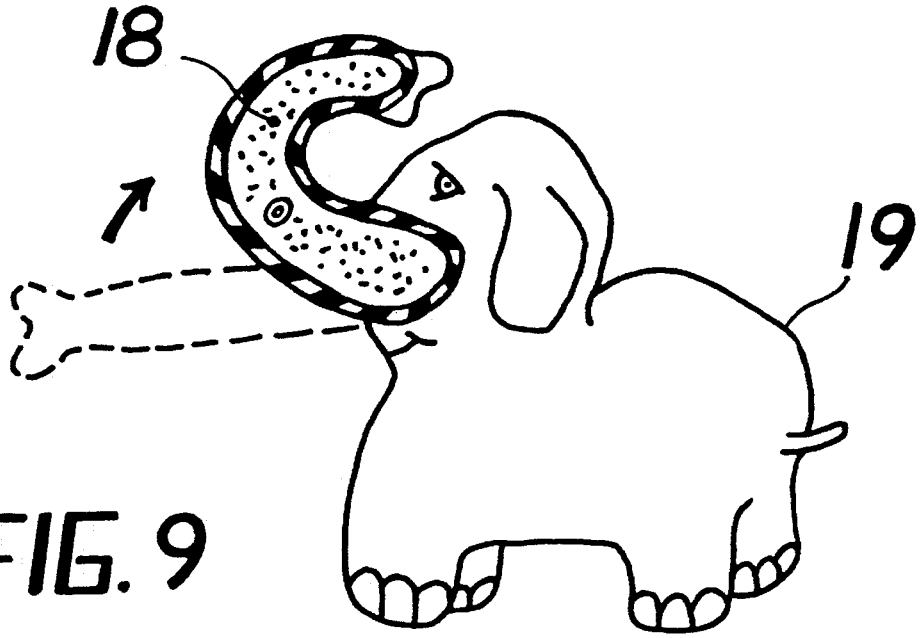
FIG. 9 is a diagrammatic elevational view, partly in cross-sectional of a toy elephant character according to the invention.

In the embodiment shown in FIG. 9, the toy is a simulated elephant character 19 having an insert 18 in the trunk. The insert may be molded in either coiled or uncoiled condition to which it will return slowly after deformation to the other condition.

Figure 10:
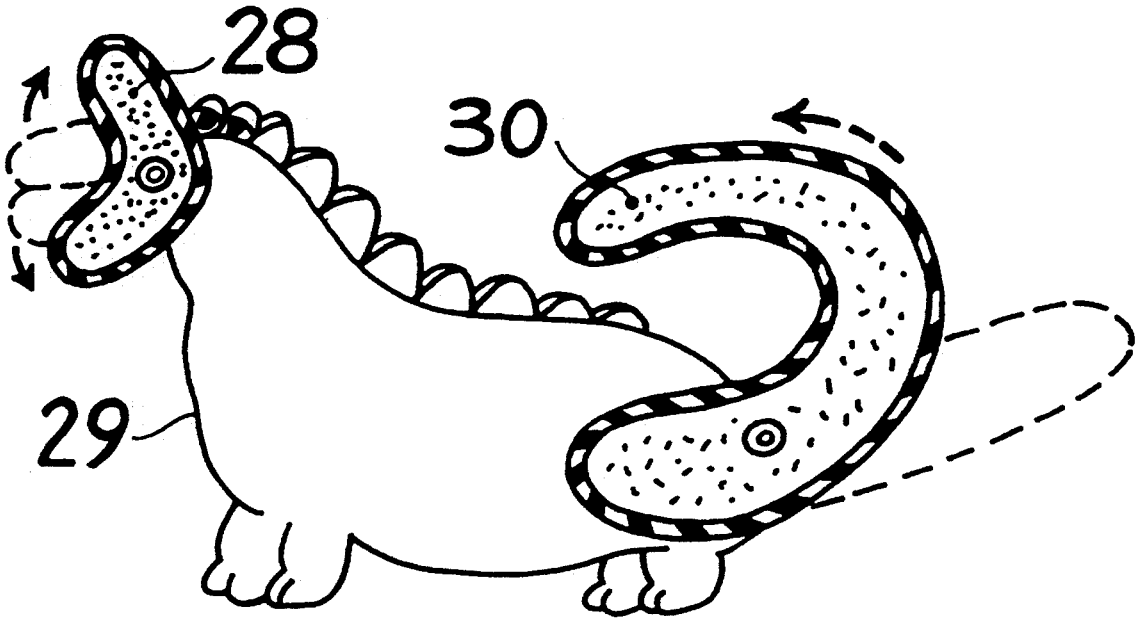
FIG. 10 is a diagrammatic elevational view, partly in cross-sectional of a toy dinosaur character according to the invention.

In the embodiment shown in FIG. 10, the toy is a simulated dinosaur character 29 having suitably configured inserts 28 and 30, respectively, in the mouth and tail. The insert 28 extends into upper and lower jaws and is molded as shown to return slowly to a gaping mouth position when deformed to a closed mouth position indicated by broken lines. The insert 30 is molded in coiled condition to which it will return slowly after deformation to the straight position shown in broken lines.

Figure 11:
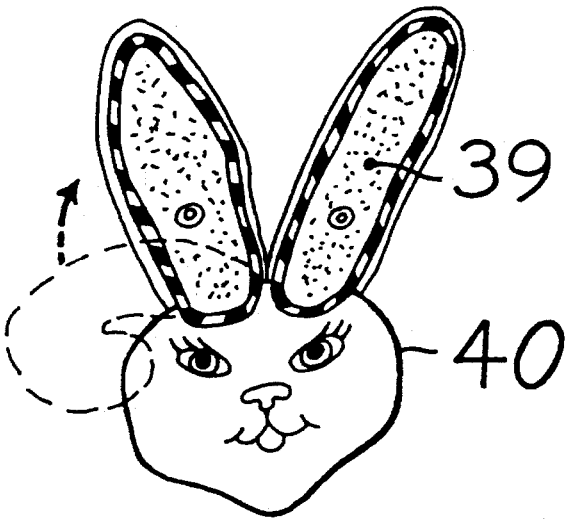
FIG. 11 is a diagrammatic elevational view, partly in cross-sectional of a the head of a toy dog or bunny character according to the invention.

In the embodiment shown in FIG. 11, suitably configured inserts 39 are concealed in the ears of a simulated dog or bunny character 40. The ears will uncoil slowly after being compressed and coiled.

Figure 12:
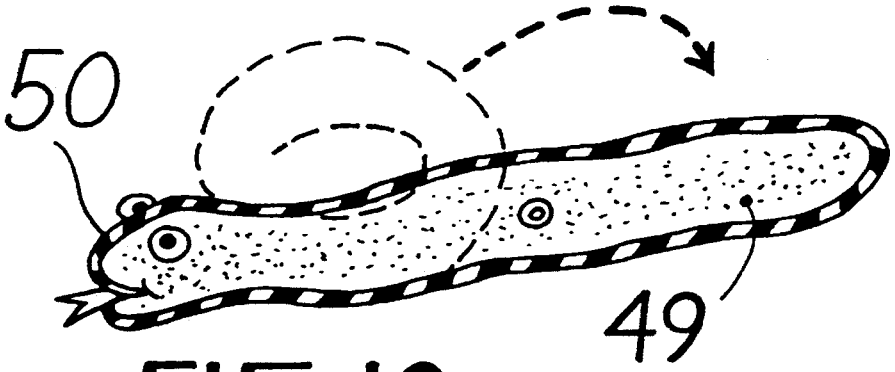
FIG. 12 is a diagrammatic elevational view, partly in cross-sectional of a toy snake character according to the invention.

In the embodiment shown in FIG. 12, a long and narrow insert 49 extends along a simulated snake character 50. The snake will uncoil slowly after being compressed and coiled as indicated by the broken lines.

Figure 13:
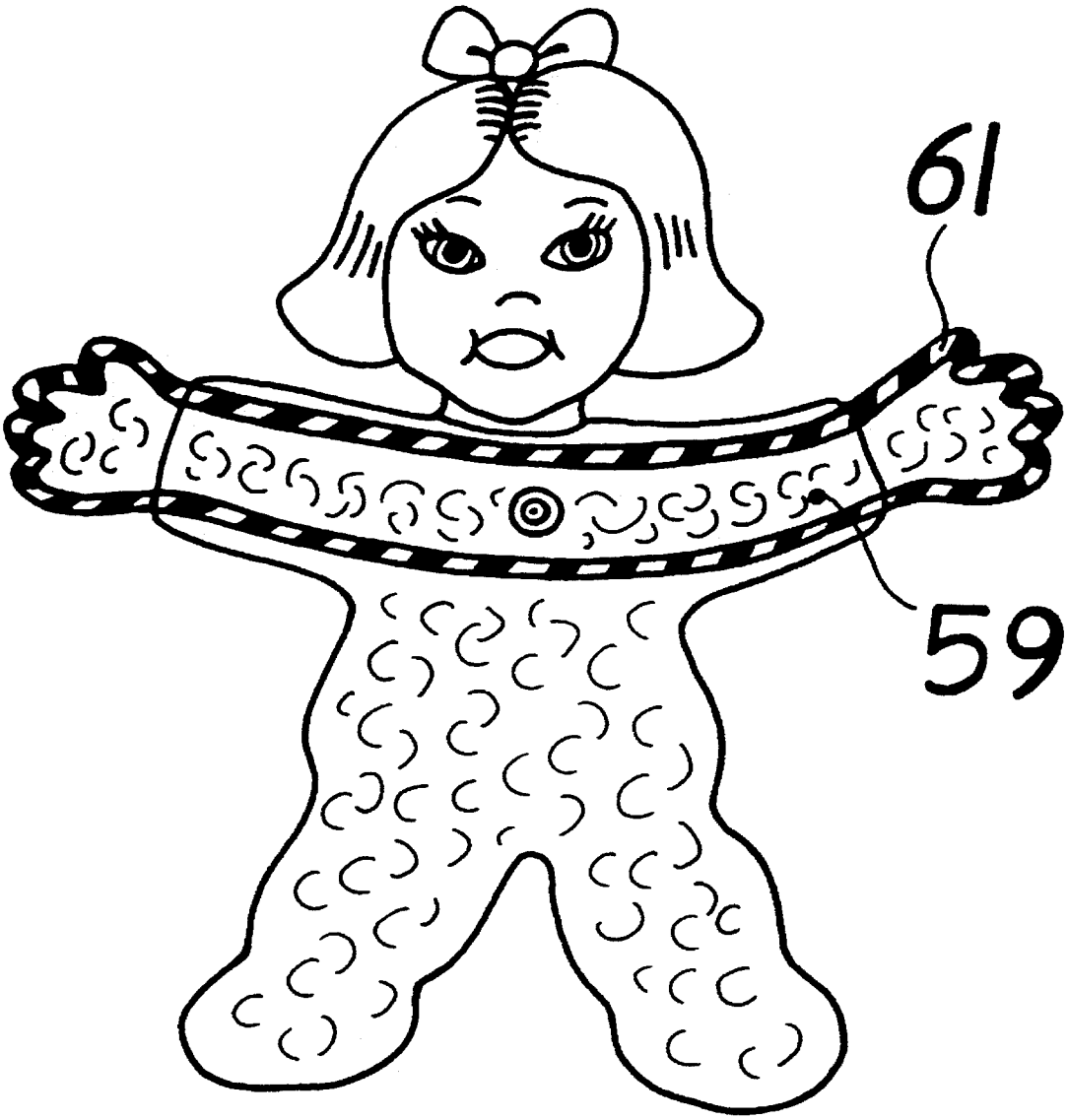
FIG. 13 is a diagrammatic elevational view, partly in cross-section, of another embodiment of toy doll according to the prior art; and, FIG. 14 is a diagrammatic elevational view, partly in cross-section, of yet another embodiment of a fantasy sausage character according to the prior art.

In the embodiment shown in FIG. 13, the air bag 59 of the insert is mounted to extend across the chest of the doll and along respective arms with repective opposite ends of the air bag exposed form the fabric covering of the body and formed as respective hands 61. Operation is similar to that of the first embodiment.

Figure 14:
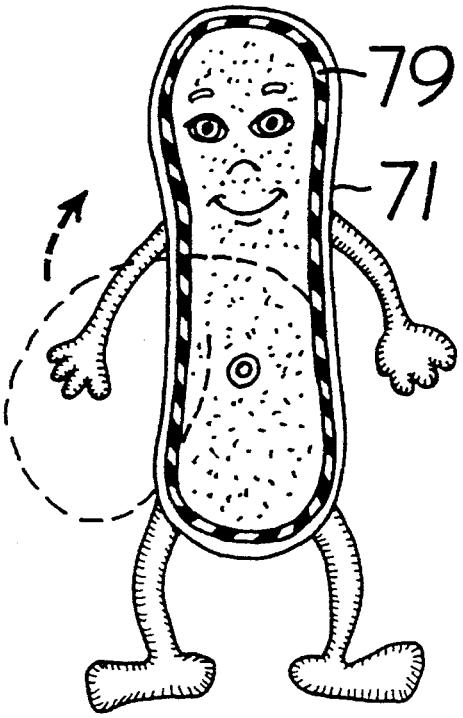

In the embodiment shown in FIG. 14, the body 71 has the form of a sausage with arms and legs and the air bag 79 substantially fills the entire body. The air bag will slowly restore the body to the upright position after deformation to the bent position shown in broken lines.

I claim:

1. A life-size huggable doll having a body comprising a porous, soft, cloth like fabric covering a soft stuffing, the body including a flexible pair of arms extending from a chest portion in one of open and closed positions, a slow return motion producing insert comprising an elongate, tubular, resiliently compressible air bag with a slow leak means and mounted in the body to extend across the chest and along respective arms, whereby a child can deform the arms from one of the positions to another, compressing the air bag and the resiling action of which returns said arms slowly to an undeformed position while producing a simulated natural gesture of affection.

2. A doll according to claim 1 wherein the air bag comprises an impermeable skin stuffed with resiliently compressible foam.

3. A doll according to claim 1 wherein the air bag is of U-shape in undeformed condition, locating the arms extending together forward from the chest so that the arms can be deformed by a child to an open position extended outwardly away from each other from opposite sides of the chest and will return relatively slowly producing a simulated hugging gesture.

4. A doll according to claim 1 wherein the air bag may be straight in undeformed condition, locating the arms extending outwardly, away from each other from opposite sides of the chest so that the arms can be deformed by a child to a position extending together, in front of the chest and will return relatively slowly, moving apart simulating a gentle request for a hug and an expression of love.

5. A toy character comprising an appendage which extends from a body portion and which is flexible for movement by a child relative to the body portion between bent and extended positions, a slow return motion producing insert consisting essentially of an elongate, narrow, tubular, resiliently compressible air bag comprising an impermeable skin stuffed with resiliently compressible foam with slow leak means, positioned from the body portion inside and along the appendage, whereby flexure of said appendage from one of the positions to the other of the positions compresses the air bag so that resiling action of the air bag causes slow motion return movement of said appendage to one of the positions thereby producing a simulated natural movement.

6. A toy character having a form of a doll including a flexible pair of arms extending from a chest and which are flexible for movement by a child between bent, closed and extended, open positions, a slow return motion producing insert consisting essentially of an elongate, narrow, tubular, resiliently compressible air bag with slow leak means, mounted to extend across and inside the chest and along and inside respective arms with repective opposite ends of the air bag exposed and formed as respective hands, whereby a child can deform the arms from one of the positions to another, compressing the air bag, the resiling action of which returns said arms slowly to an undeformed position while producing a simulated natural gesture of affection.

7. A toy character having a form of an elephant comprising a trunk which is flexible for movement by a child between bent and extended positions, a slow return motion producing insert consisting essentially of an elongate, narrow, tubular, resiliently compressible air bag comprising an impermeable skin stuffed with resiliently compressible foam with slow leak means, positioned at least partly inside the trunk, whereby flexure of said trunk from one of the positions to the other of the positions compresses the air bag so that resiling action of the air bag causes slow motion return movement of said trunk to one of the positions thereby producing a simulated natural gesture being one of a trunk uncoiling and coiling.

8. A toy character having a form of a dinosaur comprising an appendage having a form of a tail which is flexible for movement by a child between bent and extended positions, a slow return motion producing insert consisting essentially of an elongate, narrow, tubular, resiliently compressible air bag comprising an impermeable skin stuffed with resiliently compressible foam with slow leak means, positioned at least partly inside the tail, whereby flexure of said tail from one of the positions to the other of the positions compresses the air bag so that resiling action of the air bag causes slow motion return movement of said tail to one of the positions thereby producing a simulated natural gesture being one of a tail uncoiling and coiling.

9. A toy character having a form of a dinosaur comprising an appendage which is a mouth, flexible for movement by a child between bent and extended positions, a slow return motion producing insert consisting essentially of an elongate, narrow, tubular, resiliently compressible air bag comprising an impermeable skin stuffed with resiliently compressible foam with slow leak means, positioned to extend inside upper and lower jaws, whereby flexure of said mouth from one of the positions to the other of the positions compresses the air bag so that resiling action of the air bag causes slow motion return movement of said jaws to one of the positions thereby producing a simulated natural gesture being one of a mouth opening and closing.

10. A toy character having a form of one of a dog and bunny and comprising an ear which is flexible for movement by a child between bent and extended positions, a slow return motion producing insert consisting essentially of an elongate, narrow, tubular, resiliently compressible air bag comprising an impermeable skin stuffed with resiliently compressible foam with slow leak means, positioned at least partly inside the ear, whereby flexure of said ear from one of the positions to the other of the positions compresses the air bag so that resiling action of the air bag causes slow motion return movement of said ear to one of the positions thereby producing a simulated natural gesture being one of an ear uncoiling and coiling.

11. A toy character having a head, and a body comprising a porous, soft, cloth like fabric covering a soft stuffing, the body including a flexible pair of arms extending from a chest portion in one of open and closed positions, a slow return motion producing insert comprising an elongate, tubular, resiliently compressible air bag with a slow leak means and mounted in the body to extend across the chest and along respective arms, whereby a child can deform the arms from one of the positions to another, compressing the air bag and the resiling action of which returns said arms slowly to an undeformed position while producing a simulated natural gesture of affection.

12. A toy character including a head and a pair of arms extending from a chest, the arms being flexible for movement by a child between bent, closed and extended, open positions, a slow return motion producing insert consisting essentially of an elongate, narrow, tubular, resiliently compressible air bag with slow leak means, mounted to extend across and inside the chest and along and inside respective arms with respective opposite ends of the air bag exposed and formed as respective hands, whereby a child can deform the arms from one of the positions to another, compressing the air bag, the resiling action of which returns said arms slowly to an undeformed position while producing a simulated natural gesture of affection.

13. A toy character including a head and arms extending from a main body portion which arms are flexible for movement by a child between bent, closed and extended, open positions, a slow return motion producing insert consisting essentially of an elongate, narrow, tubular, resiliently compressible air bag with slow leak means, mounted to extend across and inside the main body portion and along and inside respective arms, whereby a child can deform the arms from one of the positions to another, compressing the air bag, the resiling action of which returns said arms slowly to an undeformed position while producing a simulated natural gesture of affection.

14. A doll having a body comprising a porous, soft, cloth like fabric covering a soft stuffing, the body including a flexible pair of arms extending from a chest portion in one of open and closed positions, a slow return motion producing insert comprising an elongate, tubular, resiliently compressible air bag with a slow leak means and mounted in the body to extend across the chest and along respective arms, whereby a child can deform the arms from one of the positions to another, compressing the air bag and the resiling action of which returns said arms slowly to an undeformed position while producing a simulated natural gesture of affection.

* * * * *